US010646787B2

(12) United States Patent
Cheung

(10) Patent No.: US 10,646,787 B2
(45) Date of Patent: May 12, 2020

(54) MIX AND MATCH TOY KIT

(71) Applicant: Jason Cheung, Union City, CA (US)

(72) Inventor: Jason Cheung, Union City, CA (US)

(73) Assignee: Huntar Company, Union City, CA (US)

( * ) Notice: Subject to any disclaimer, the term of this patent is extended or adjusted under 35 U.S.C. 154(b) by 0 days.

(21) Appl. No.: 14/121,800

(22) Filed: Oct. 20, 2014

(65) Prior Publication Data

US 2016/0107093 A1 Apr. 21, 2016

(51) Int. Cl.

| | |
|---|---|
| ***A63H 17/00*** | (2006.01) |
| ***A63H 33/04*** | (2006.01) |
| ***A63H 33/26*** | (2006.01) |
| ***A63H 27/00*** | (2006.01) |
| ***A63H 23/00*** | (2006.01) |

(52) U.S. Cl.

CPC ..... *A63H 17/002* (2013.01); *A63H 23/005* (2013.01); *A63H 27/001* (2013.01); *A63H 33/046* (2013.01); *A63H 33/26* (2013.01)

(58) Field of Classification Search

CPC .... A63H 33/046; A63H 33/044; A63H 33/06; A63H 33/10; A63H 17/002

See application file for complete search history.

(56) References Cited

U.S. PATENT DOCUMENTS 858,090 A * 6/1907 Meineoke ..... A63H 3/16 446/99
1,322,713 A * 11/1919 Marshall ..... A63H 3/16 446/100
2,615,227 A * 10/1952 Hornik ..... A44C 5/2071 24/303
3,090,155 A * 5/1963 Gordon ..... A63H 33/26 428/900
3,372,443 A * 3/1968 Daddona, Jr. ..... A41F 1/002 24/303
3,375,604 A * 4/1968 Alonso ..... A63H 3/16 446/92
4,026,086 A * 5/1977 Langley ..... E04B 2/06 335/306
4,265,002 A * 5/1981 Hosken ..... A41F 1/002 24/303
4,480,361 A * 11/1984 Morita ..... A45C 13/1069 24/303
5,311,647 A * 5/1994 Levy ..... A44C 5/2042 24/303
5,722,126 A * 3/1998 Reiter ..... A41F 1/002 24/303
6,009,601 A * 1/2000 Kaufman ..... A41F 1/002 24/303
6,431,936 B1 * 8/2002 Kiribuchi ..... A63H 33/046 446/129
6,595,824 B2 * 7/2003 Calello ..... A63H 17/002 446/93
6,749,482 B1 * 6/2004 Hollis ..... A63H 17/002 446/466

(Continued)

*Primary Examiner* — Melba Bumgarner
*Assistant Examiner* — Amir A Klayman
(74) *Attorney, Agent, or Firm* — Jonathan E. Grant; Grant Patent Services

(57) ABSTRACT

A mix or match toy set is disclosed wherein four units having a common theme have at least two or three sections. These two or three sections can be interchanged with one another. In one embodiment the units are different transportation vehicles. The units are held together by using magnets in male and female connectors.

12 Claims, 20 Drawing Sheets

(56) References Cited

U.S. PATENT DOCUMENTS 7,152,282 B2 * 12/2006 Costa ..... A44C 5/20 24/303
7,291,052 B2 * 11/2007 Ellman ..... A63H 3/16 446/100
7,520,793 B2 * 4/2009 Pillai ..... A63H 3/16 446/92
8,800,117 B2 * 8/2014 Fiedler ..... A44B 11/258 24/303
2004/0077259 A1 * 4/2004 Barri ..... A63H 3/46 446/92
2005/0164595 A1 * 7/2005 Toht ..... A63H 33/046 446/92
2005/0170739 A1 * 8/2005 Zoellner ..... A63H 33/046 446/92
2008/0143141 A1 * 6/2008 Ruslanov ..... A63H 17/262 296/181.1
2009/0130950 A1 * 5/2009 Deutschman ..... A63H 3/02 446/370
2009/0181595 A1 * 7/2009 Song ..... A63H 33/046 446/92
2010/0120322 A1 * 5/2010 Vicentelli ..... A63H 33/046 446/92
2011/0131770 A1 * 6/2011 Fiedler ..... A45C 13/1069 24/303
2012/0270465 A1 * 10/2012 Park ..... A63H 33/046 446/129
2013/0343025 A1 * 12/2013 Bdeir ..... H01R 13/6205 361/803
2014/0113521 A1 * 4/2014 Davolt ..... A63H 33/046 446/92
2014/0227935 A1 * 8/2014 Yoon ..... A63H 33/046 446/92
2015/0251104 A1 * 9/2015 Lange ..... A63H 33/046 446/92

* cited by examiner

MIX AND MATCH TOY KIT

This disclosure teaches a mix or match toy wherein there are several different units composed of a plurality of sections, all having a common theme.

In one embodiment of the disclosure, the common theme is modes of transportation.

In one embodiment, each unit is comprised of at least two sections.

In another embodiment each unit is comprised of at least three sections.

In yet another embodiment, each of the units is connected to at least one other unit by the use of magnets.

In yet another embodiment of the disclosure, the sections of the units are interchangeable.

In another embodiment of the disclosure, one of the units for the transportation toy is an airplane.

In another embodiment of the disclosure, one of the units for the transportation toy is an automobile.

In another embodiment of the disclosure one of the units for the transportation toy is a locomotive.

In yet another embodiment of the disclosure, one of the embodiments is a boat.

BRIEF DESCRIPTION OF THE DISCLOSURE

The features and advantages of the present disclosure will be more apparent from the following detailed description in conjunction with the accompanying drawings, in which.

DETAILED DESCRIPTION OF THE DISCLOSURE

Figure 1:
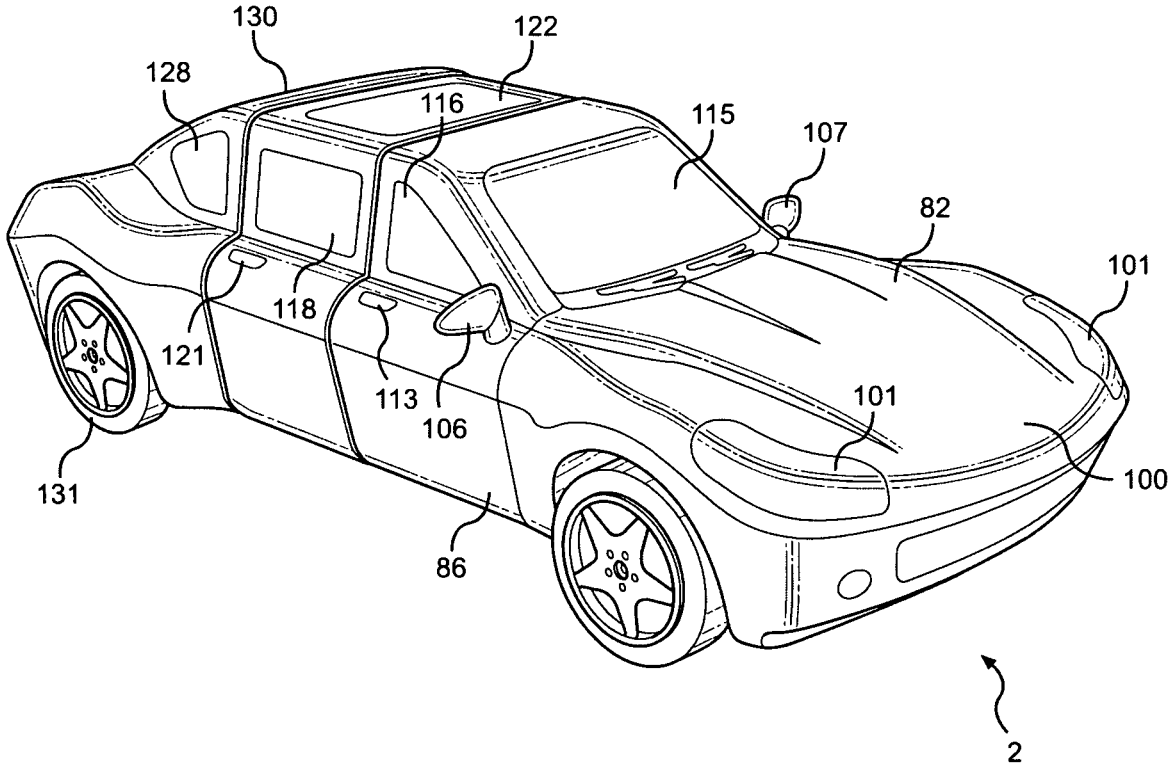
FIG. 1 is a perspective view of the automobile unit.
Figure 2:
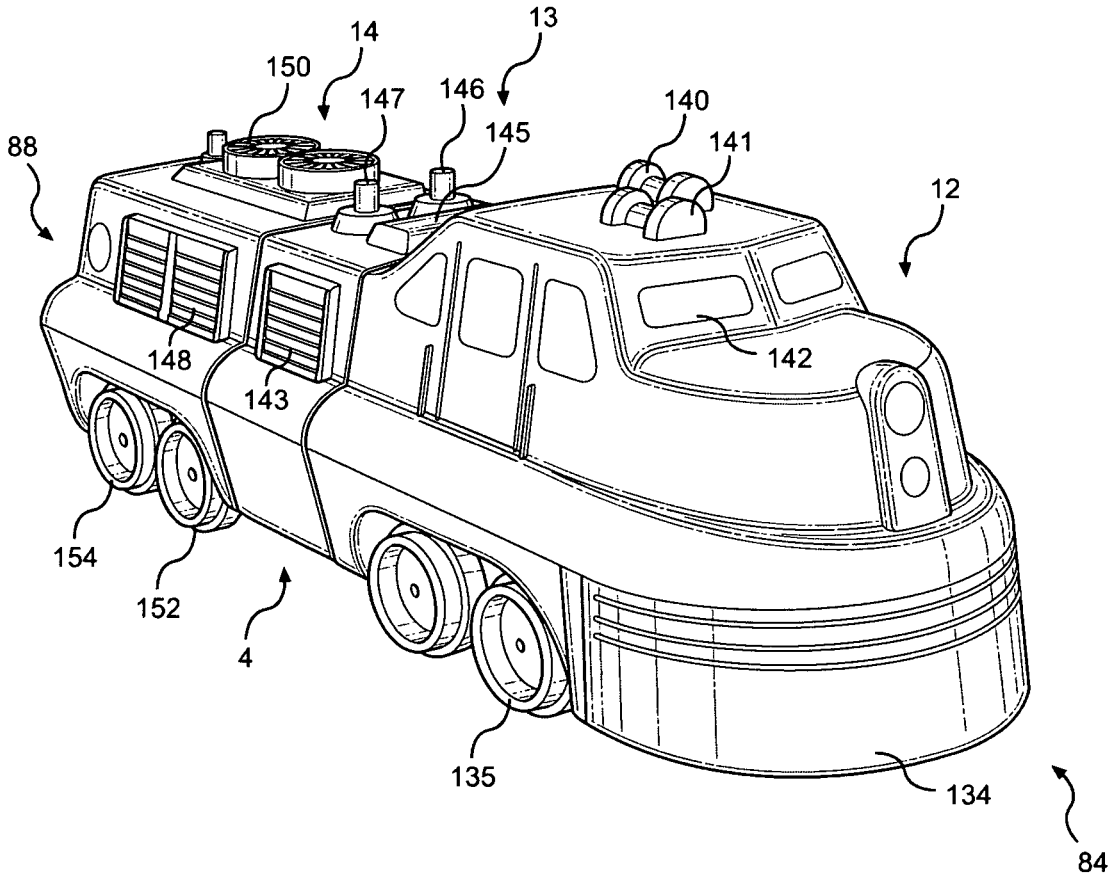
FIG. 2 is a perspective view of the locomotive unit.
Figure 3:
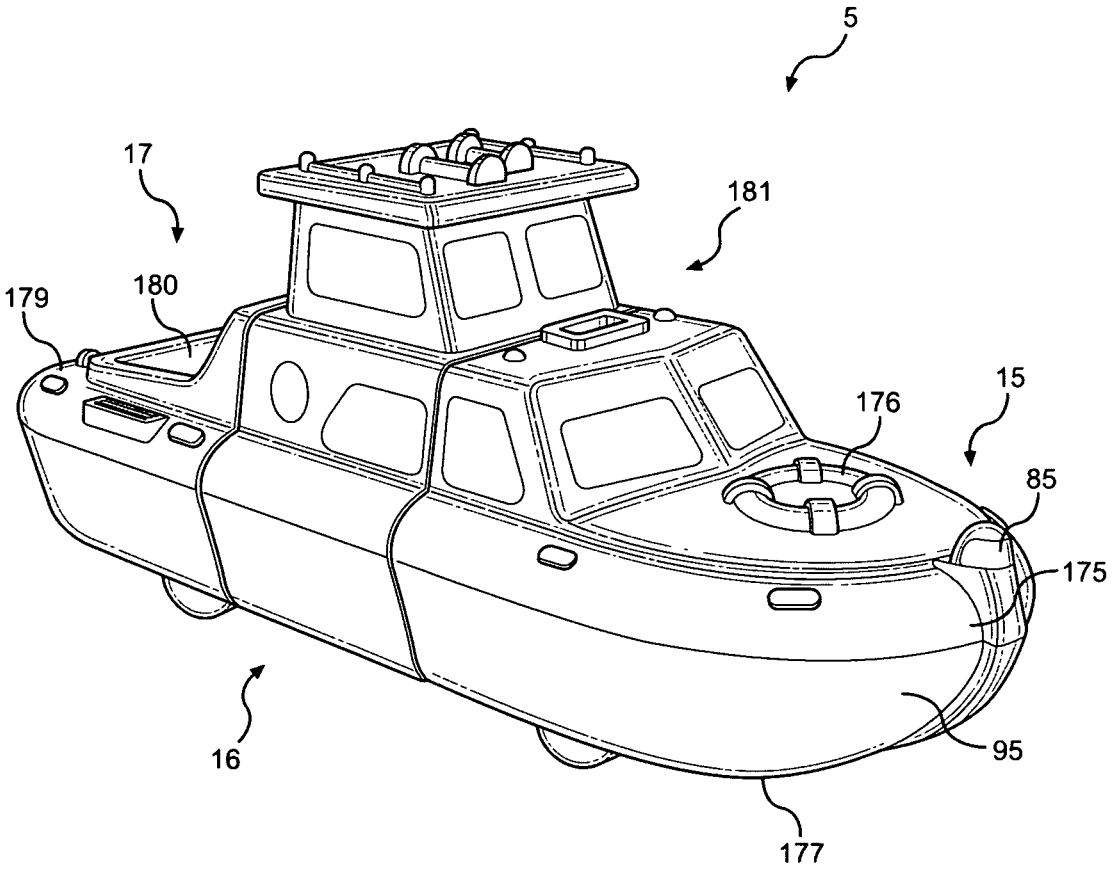
FIG. 3 is a perspective view of the boat unit
Figure 4:
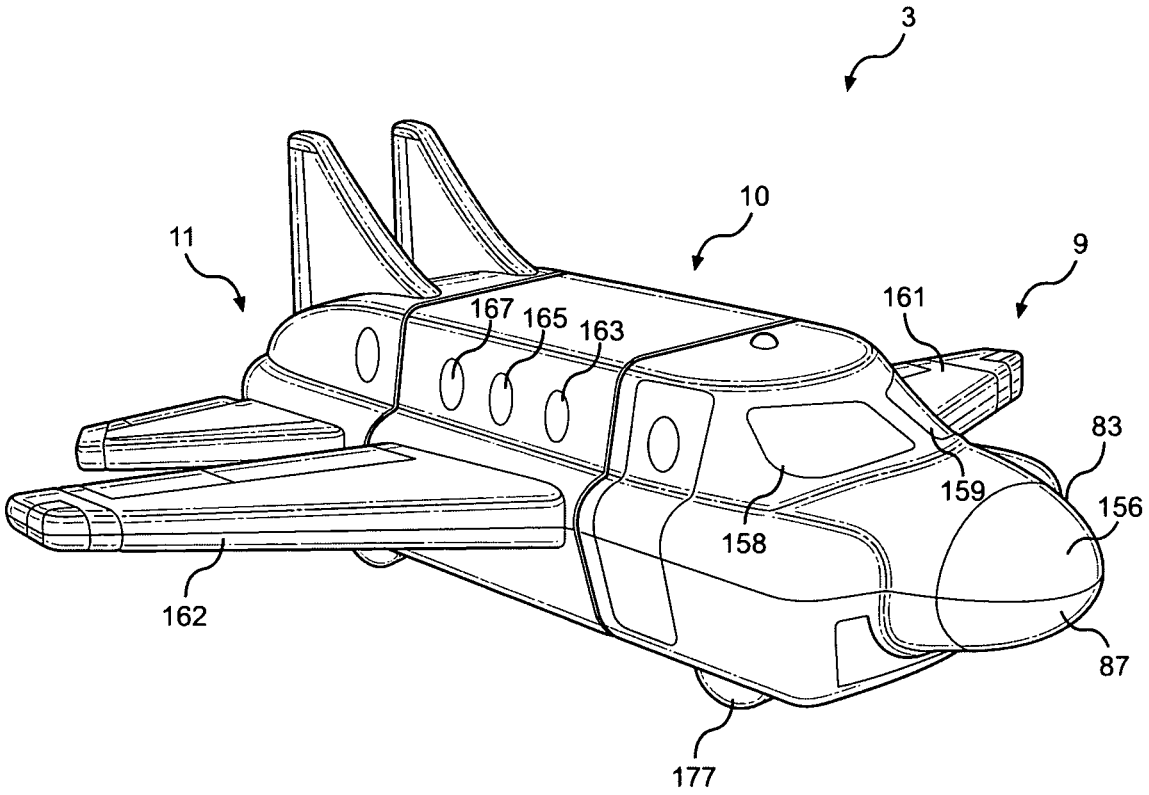
FIG. 4 is a perspective view of the airplane unit.
Figure 5:
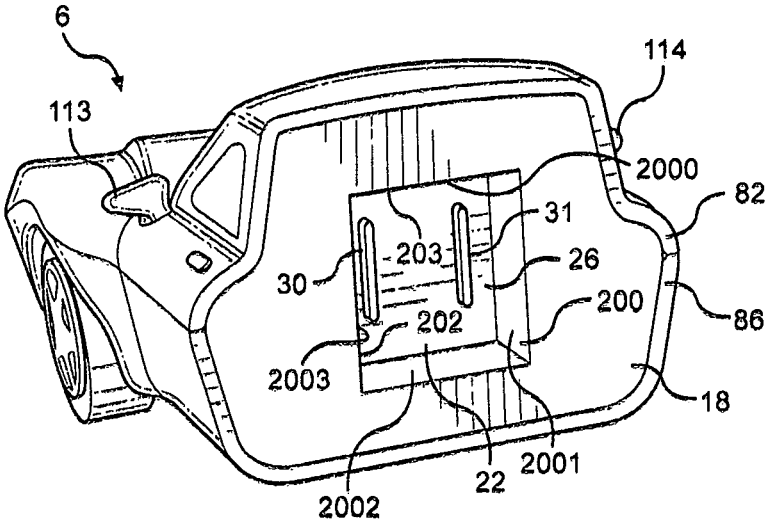
FIG. 5 is a perspective view of the distal end of the front section of automobile unit.
Figure 6:
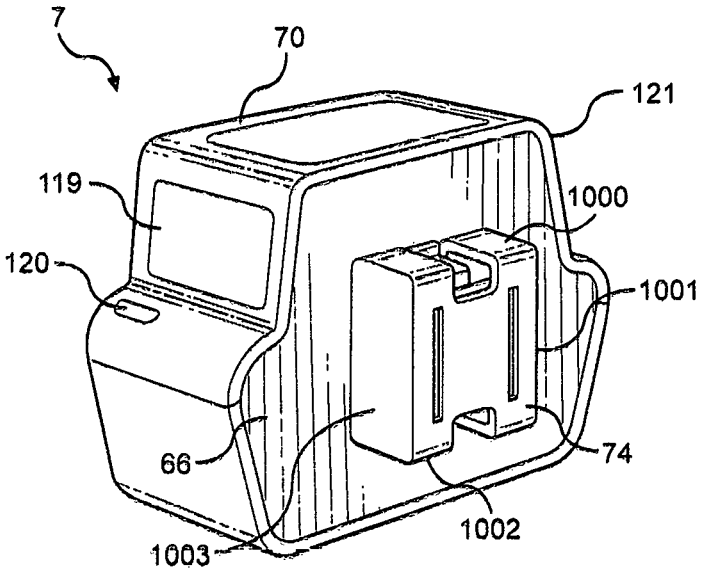
FIG. 6 is a perspective view of the proximal end of the middle section of the automobile unit.
Figure 7:
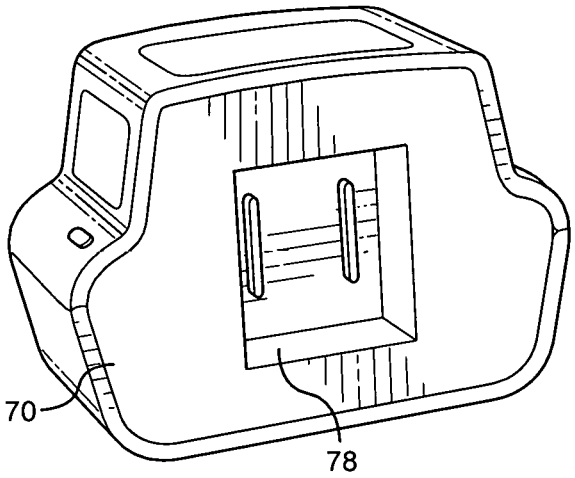
FIG. 7 is a perspective view of the distal end of the middle section of the automobile unit.
Figure 8:
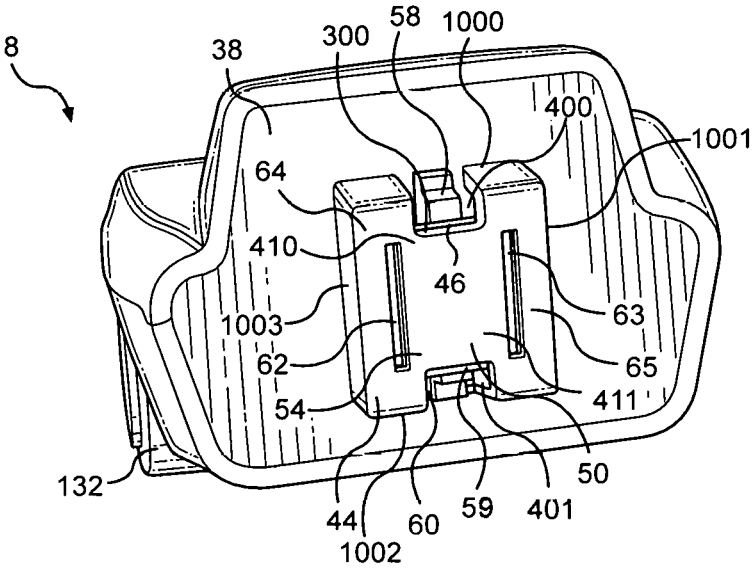
FIG. 8 is a perspective view of the proximal end of the rear section of the automobile unit.
Figure 9:
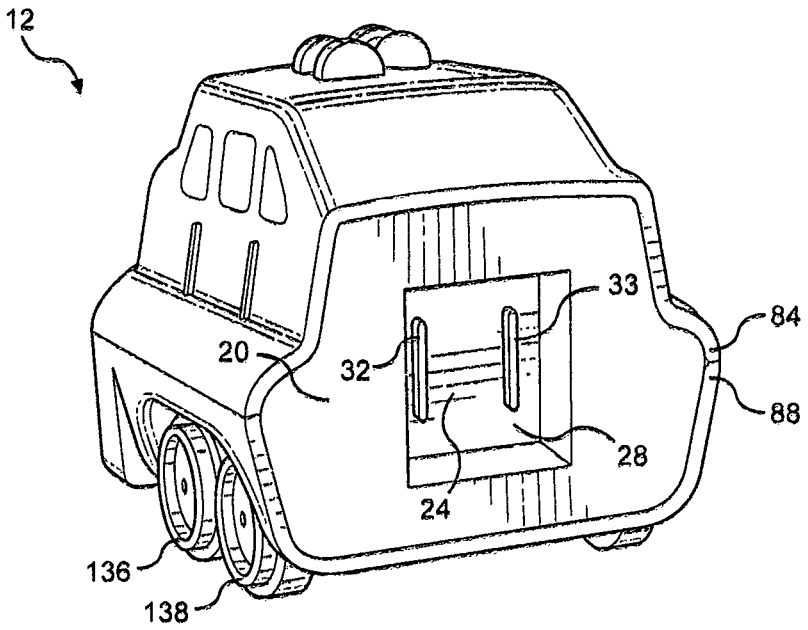
FIG. 9 is a perspective view of the distal end of the front section of the locomotive unit.
Figure 10:
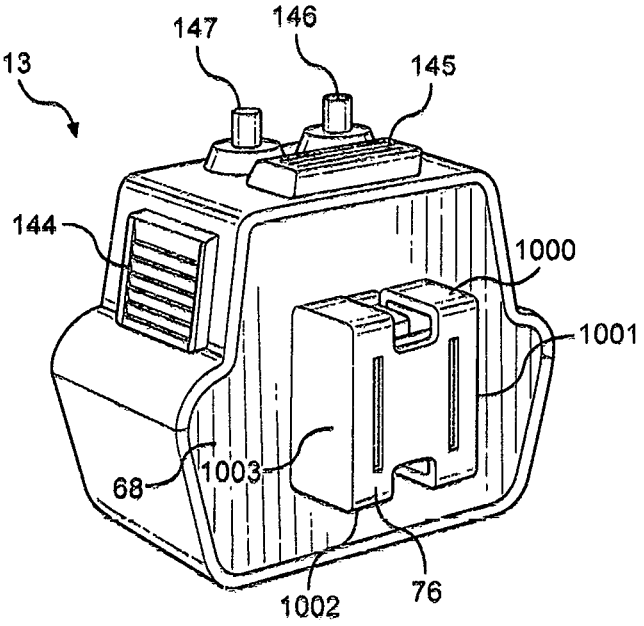
FIG. 10 is a perspective view of the proximal end of the middle section of the locomotive unit.
Figure 11:
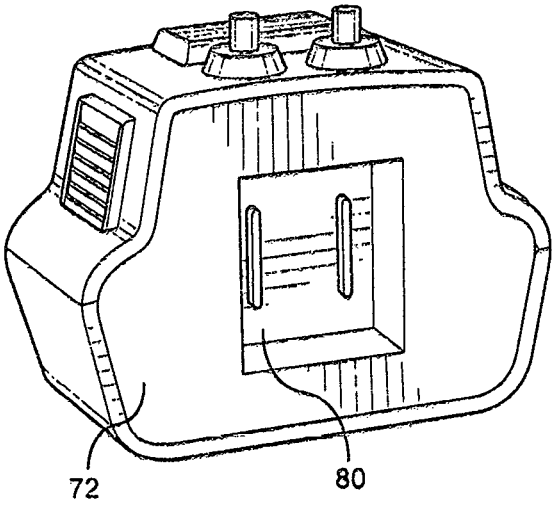
FIG. 11 is a perspective view of the distal end of the middle section of the locomotive unit.
Figure 12:
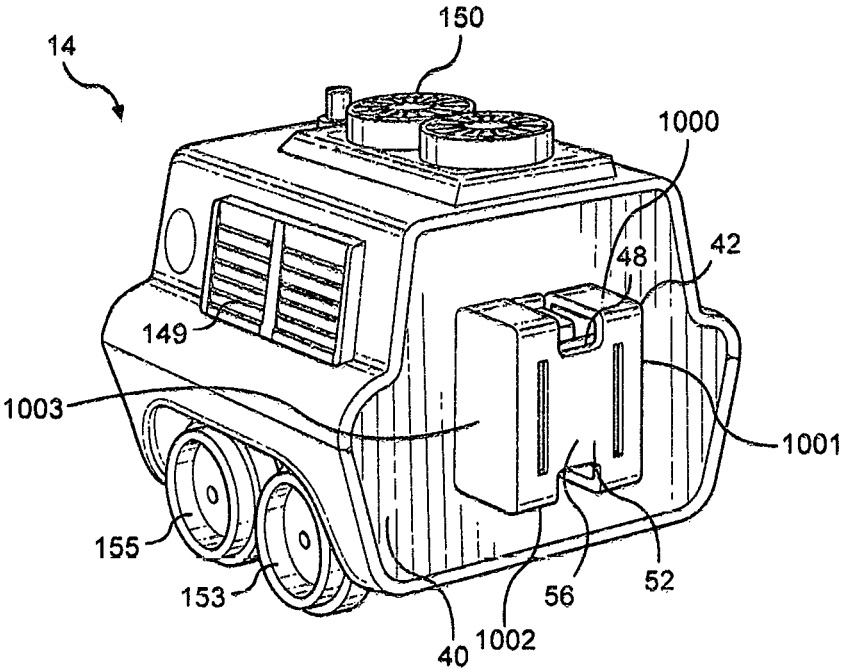
FIG. 12 is a perspective view of the proximal end of the end section of the locomotive unit.
Figure 13:
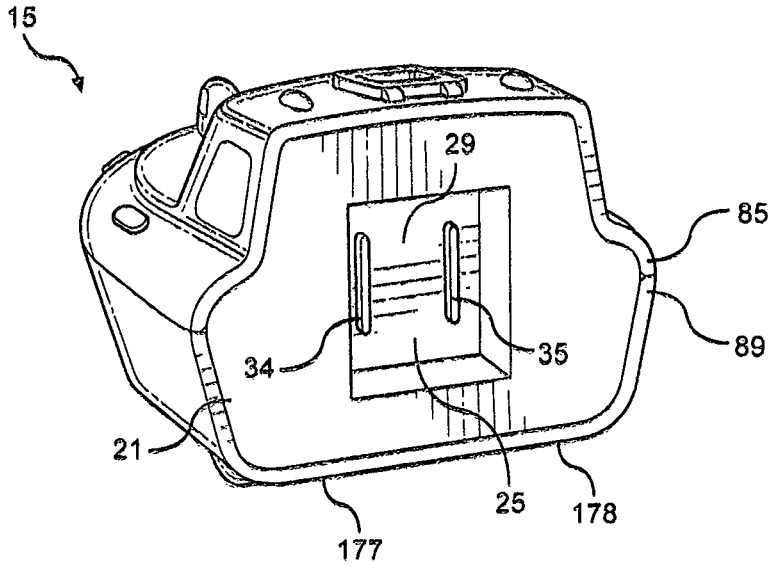
FIG. 13 is a perspective view of the distal end of the front section of the boat unit.
Figure 14:
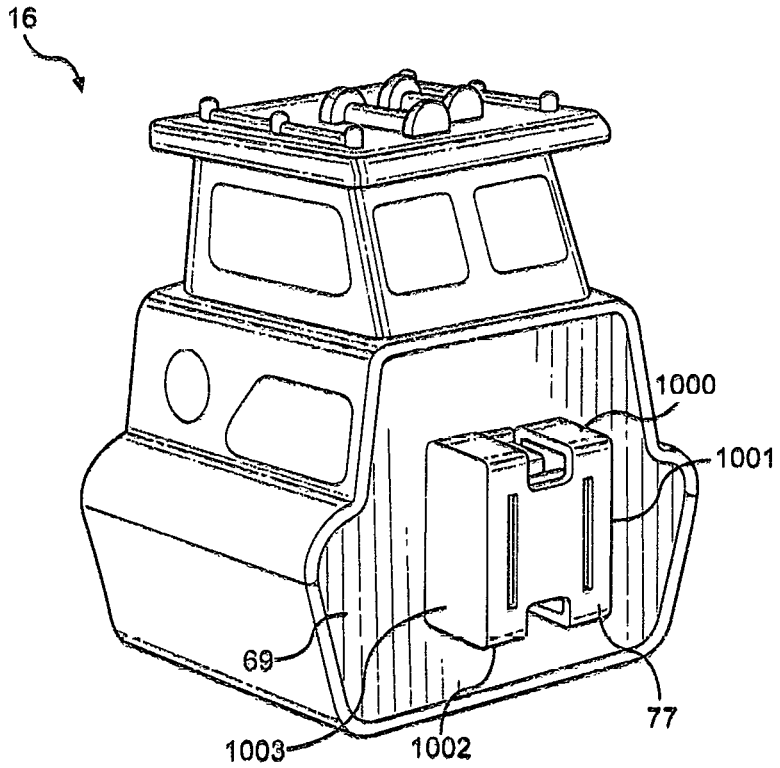
FIG. 14 is a perspective view of the proximal end of the middle section of the boat unit.
Figure 15:
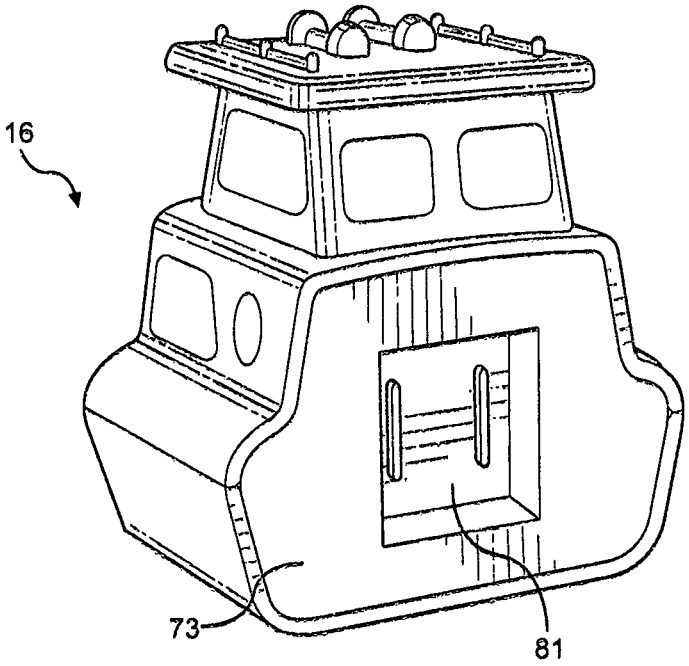
FIG. 15 is a perspective view of the distal end of the middle section of the boat unit.
Figure 16:
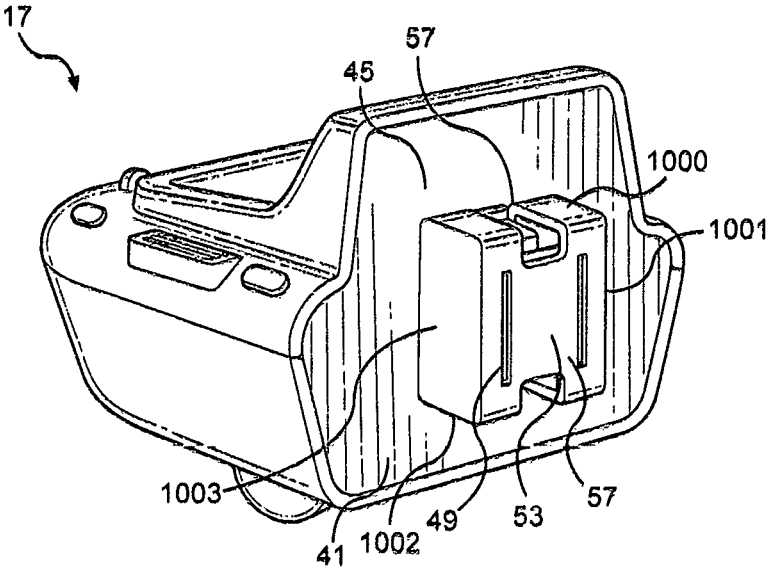
FIG. 16 is a perspective view of the proximal end of the of the end section of the boat unit.
Figure 17:
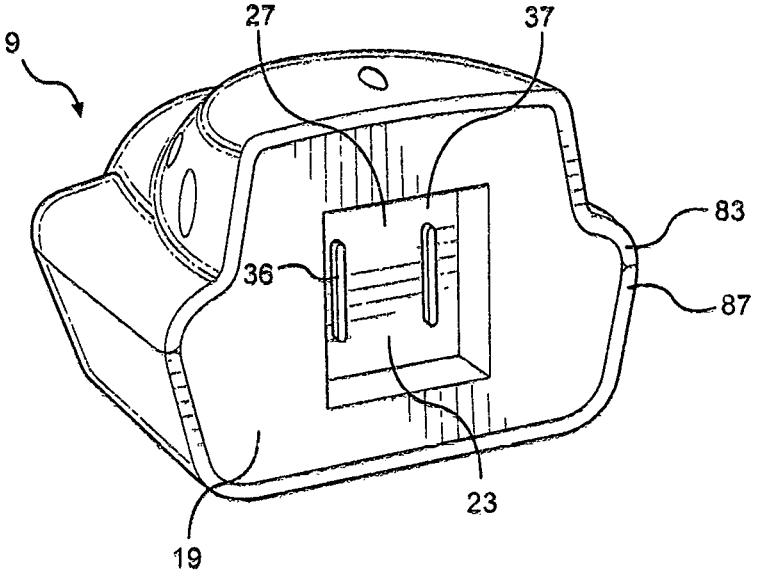
FIG. 17 is a perspective view of the distal end of the front section of the airplane unit.
Figure 18:
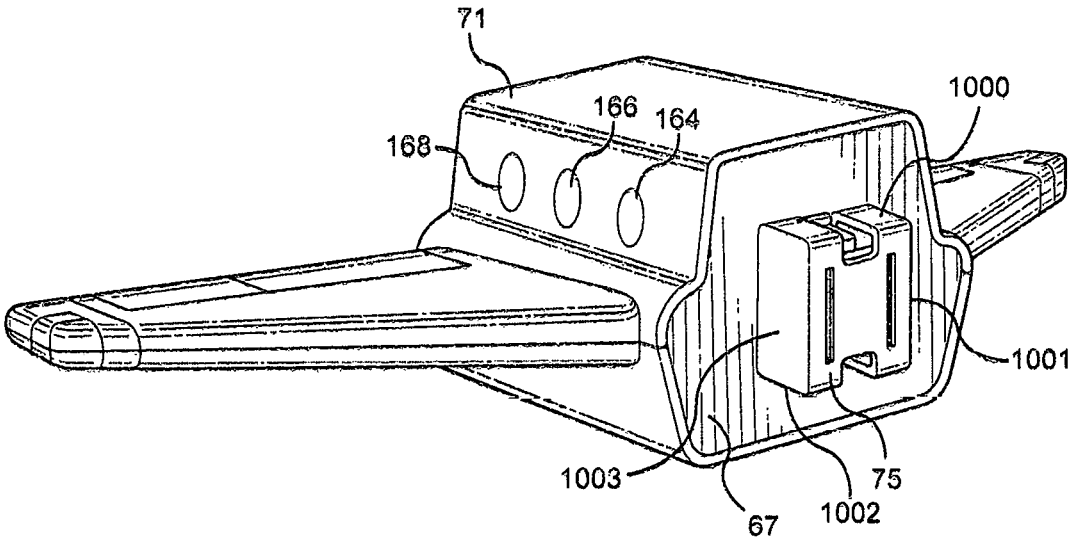
FIG. 18 is a perspective view of the proximal end of the middle section of the airplane unit.
Figure 19:
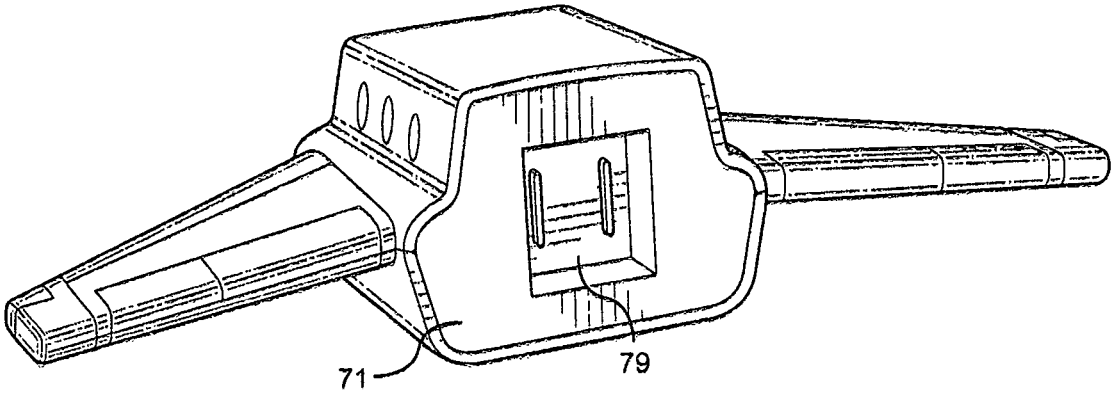
FIG. 19 is a perspective view of the distal end of the middle section of the airplane unit.
Figure 20:
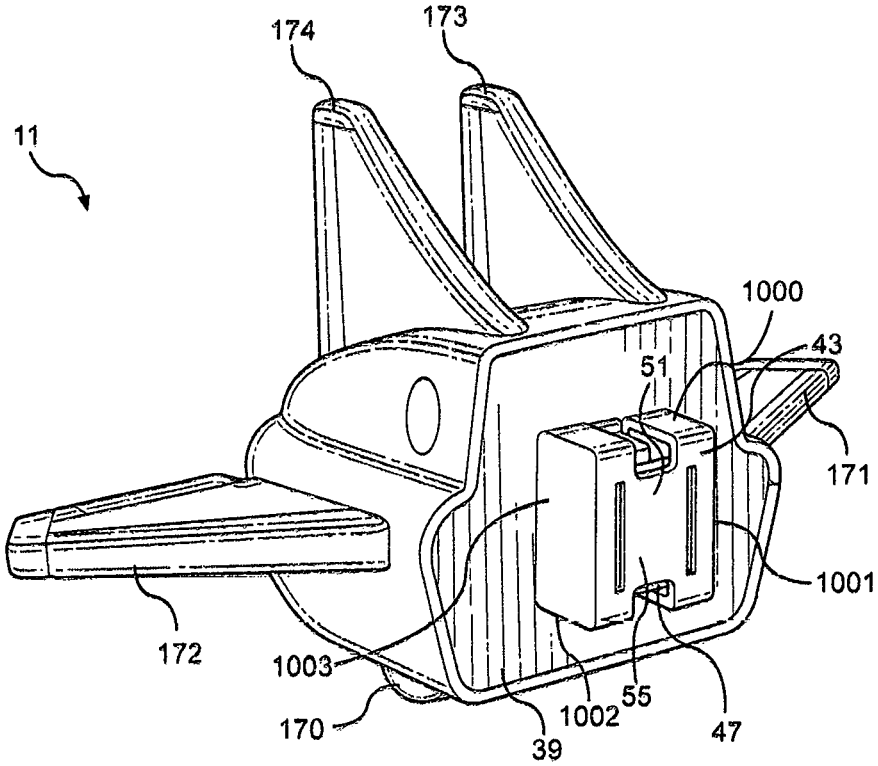
FIG. 20 is a perspective view of the proximal end of the end section of the airplane unit.
Figure 21:
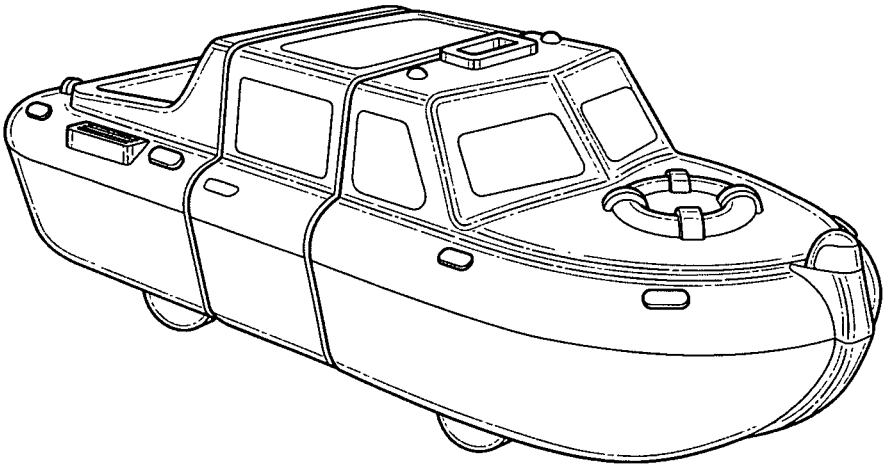
FIG. 21 is a perspective view of an interchanged mid-section vehicle assembly.
Figure 22:
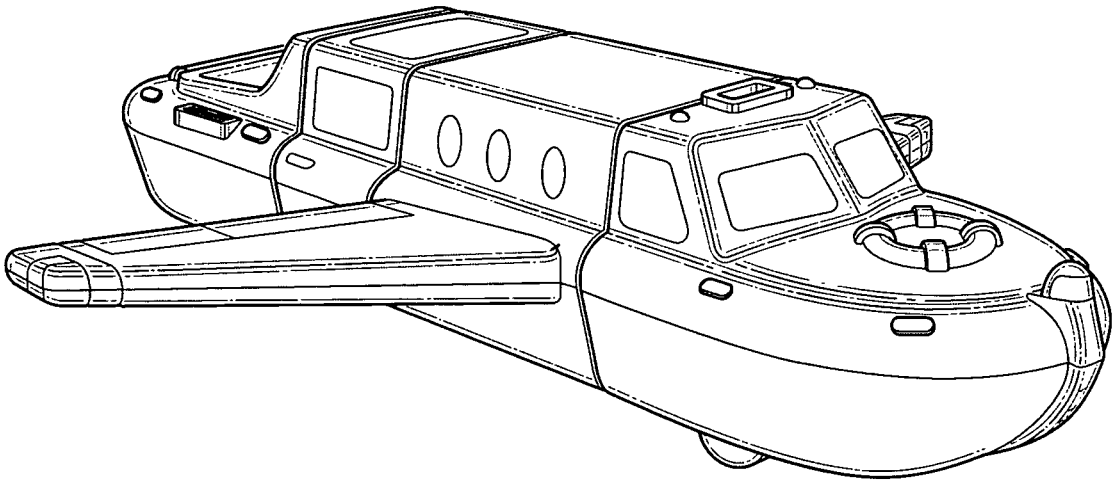
FIG. 22 is a perspective view of an additional interchanged mid-section for a vehicle.
Figure 23:
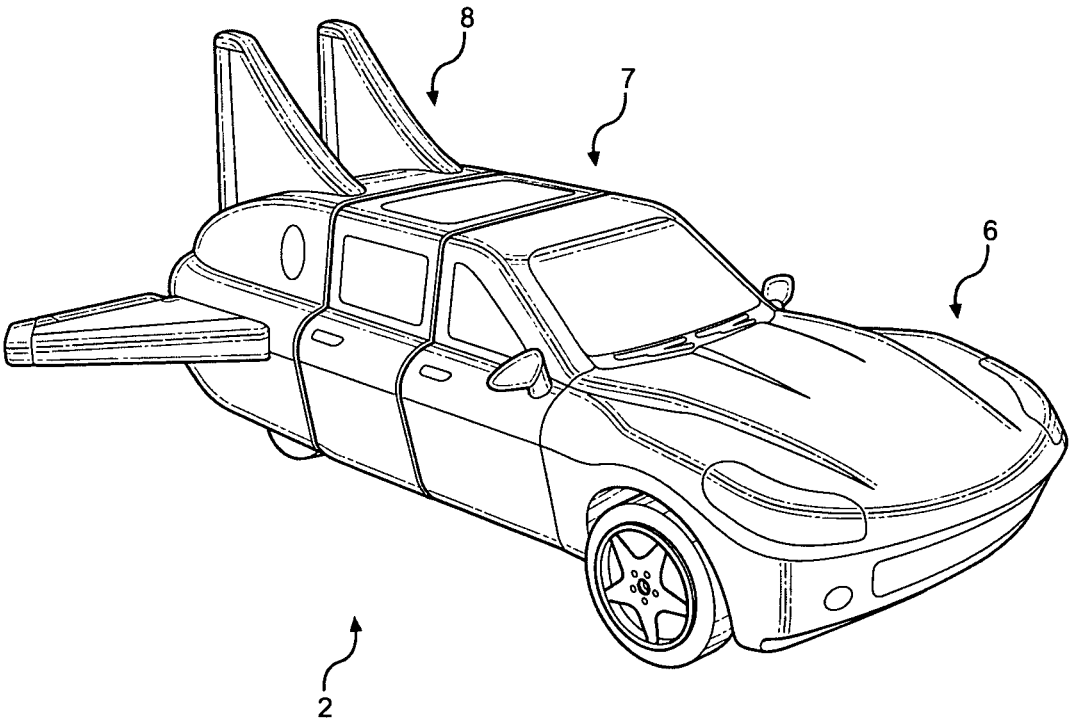
FIG. 23 is a perspective view of an interchanged end section.
Figure 24:
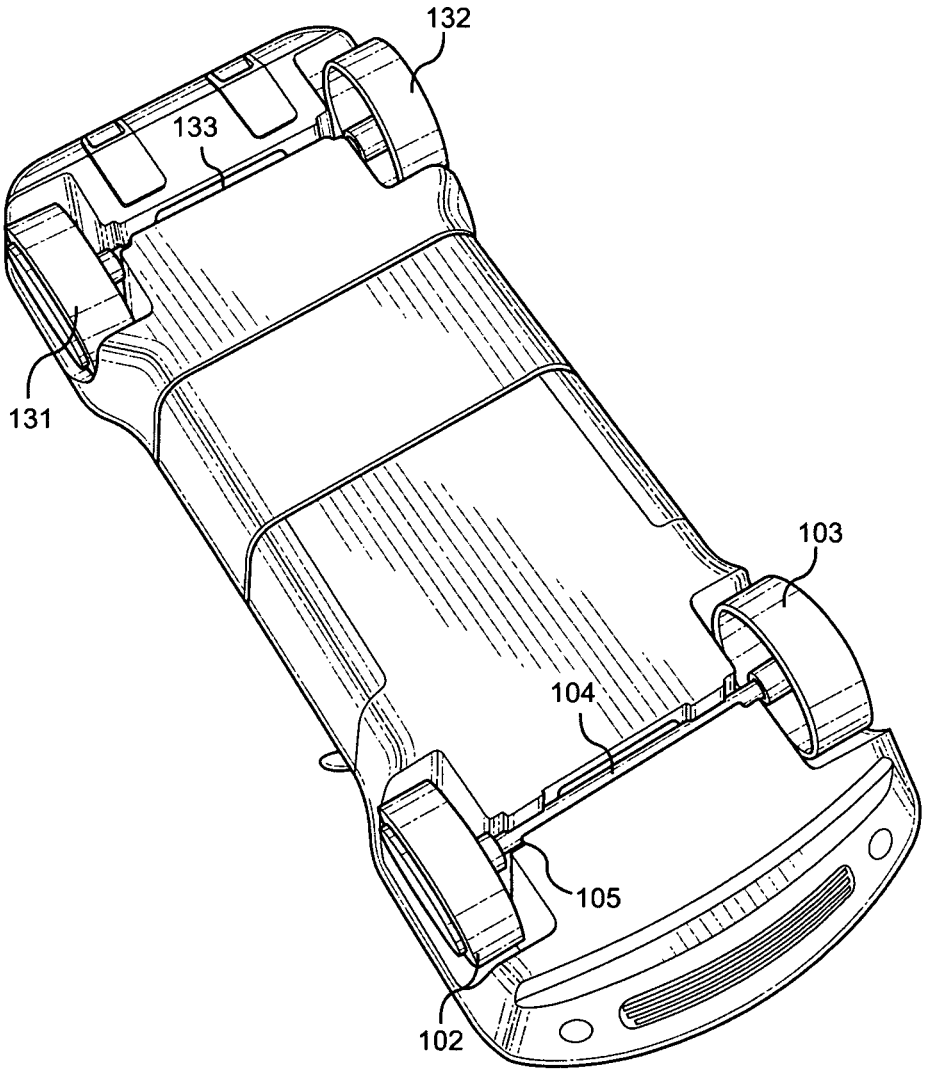
FIG. 24 is a perspective view of the underside of the automobile unit.
Figure 25:
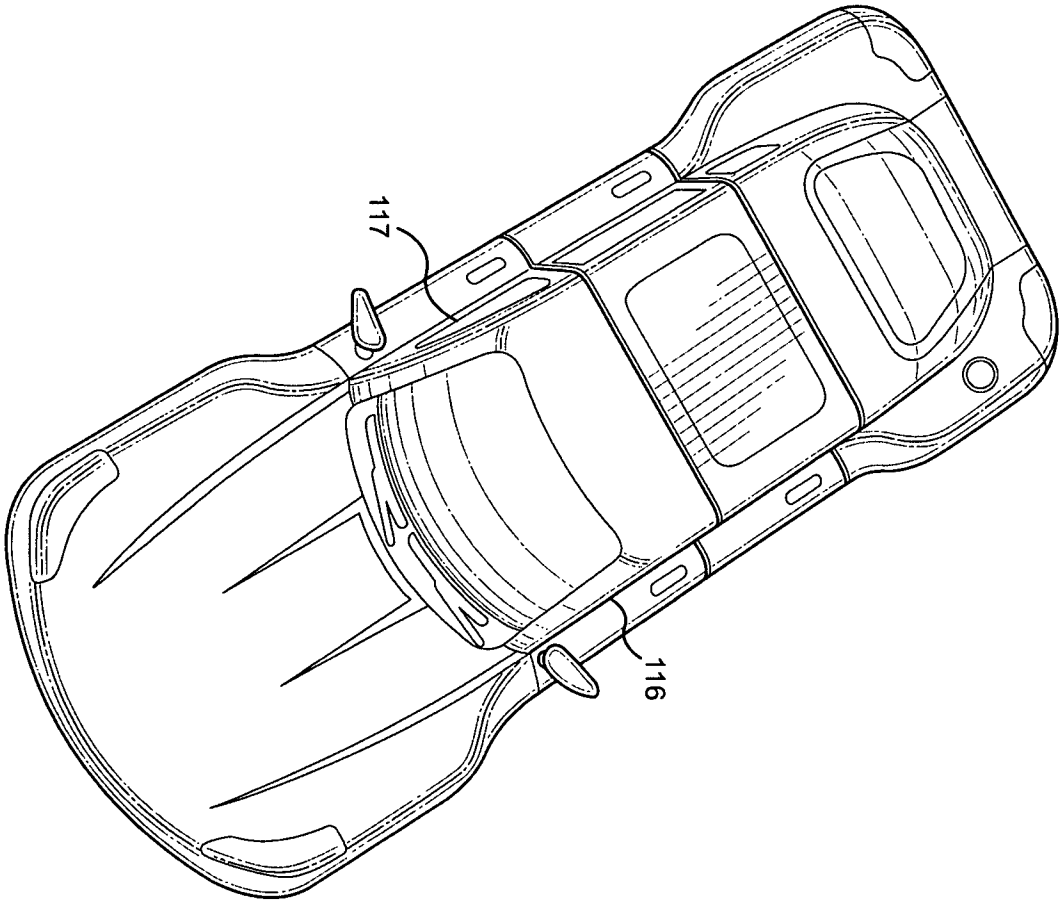
FIG. 25 is a perspective view of the top side of the automobile unit.
Figure 26:
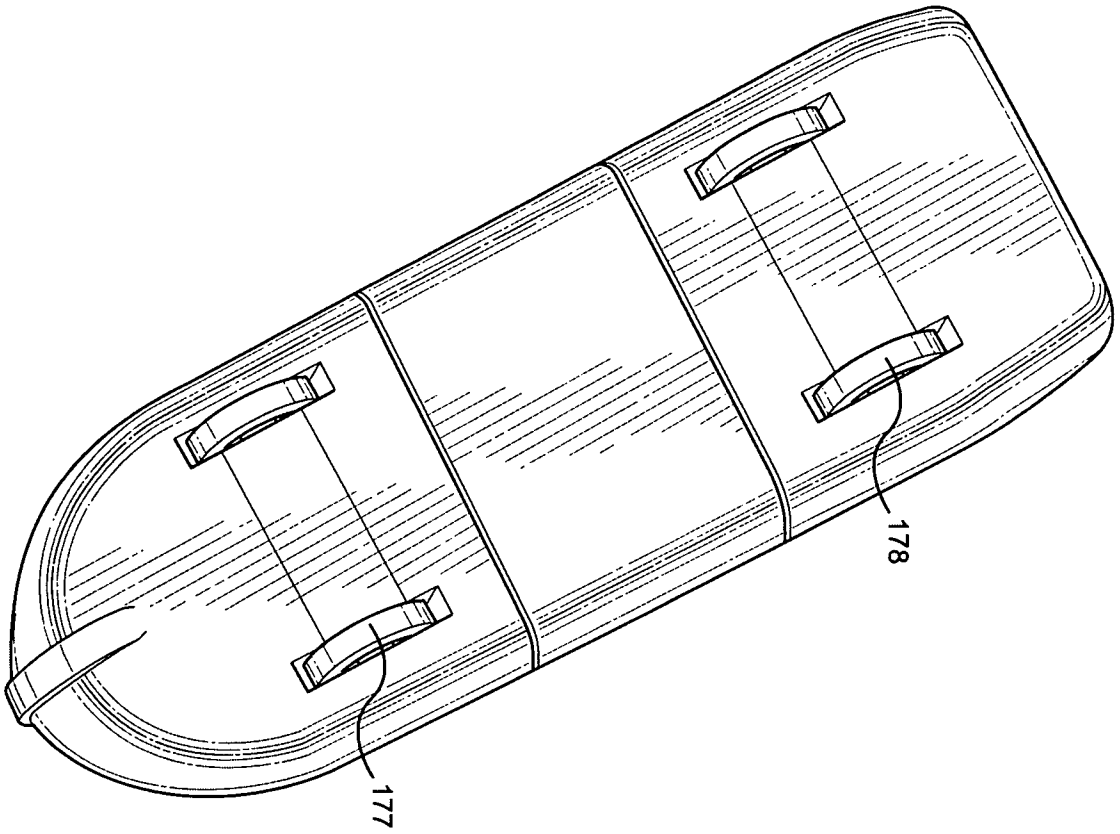
FIG. 26 is a perspective view of the underside of the boat unit.
Figure 27:
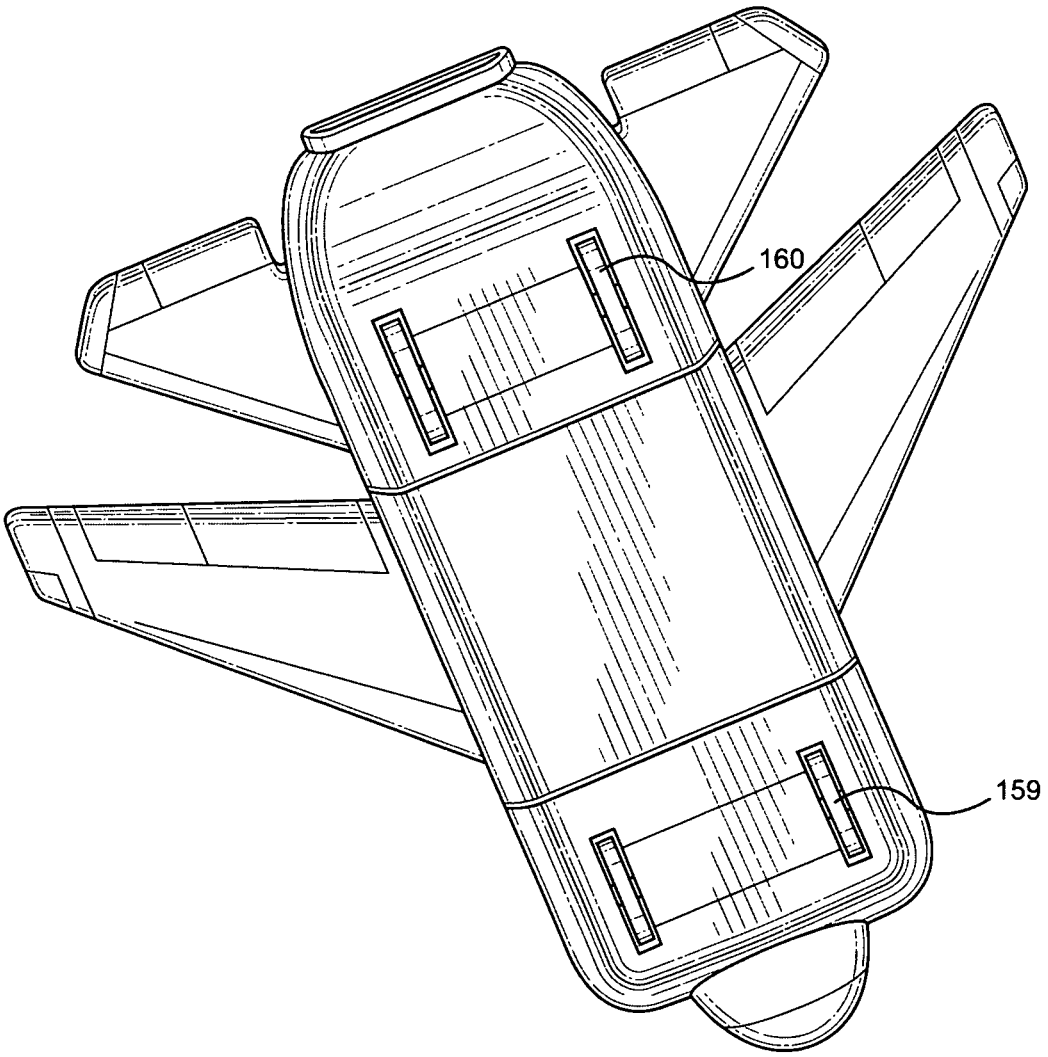
FIG. 27 is a perspective view of the underside of the airplane unit.
Figure 28:
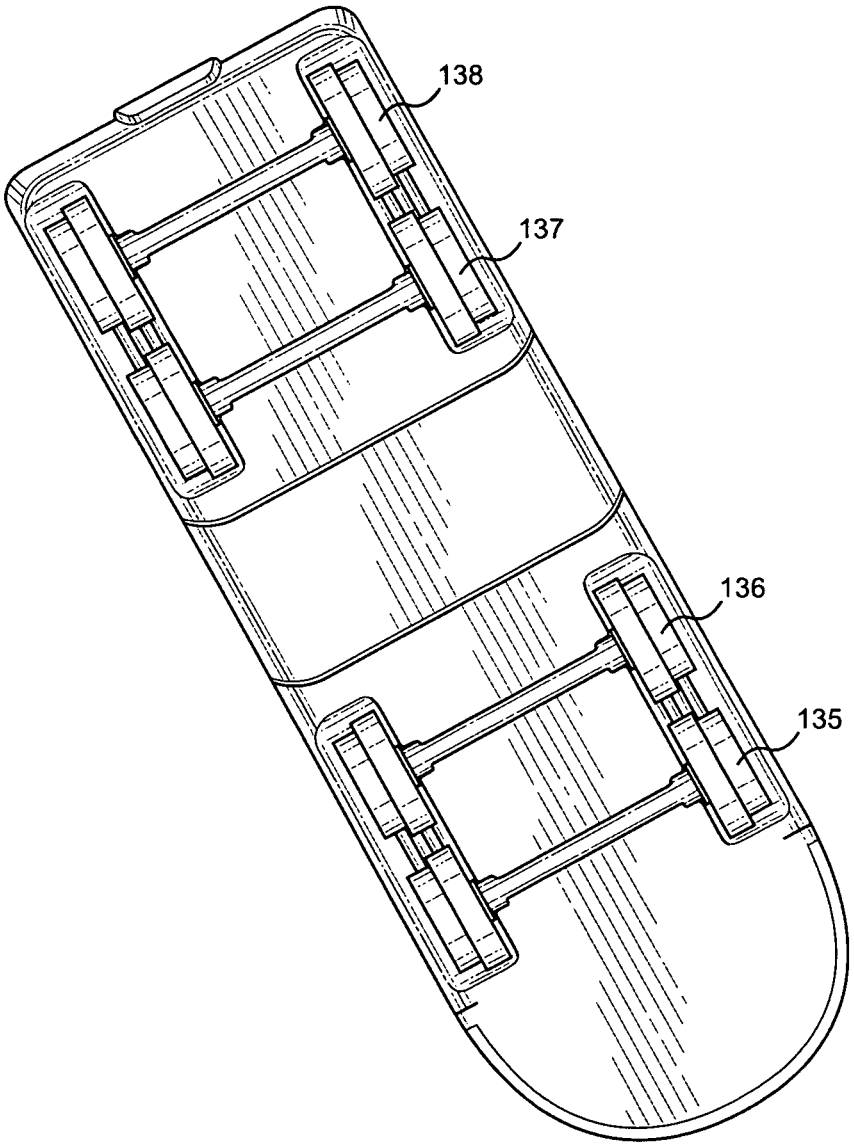
FIG. 28 is a perspective view of the underside of the locomotive unit.

Referring to FIGS. 1-2, and in one embodiment of the disclosure, the mix or match toy 1 includes an automobile unit 2, an airplane unit 3, a locomotive unit 4; and a boat unit 5. In other embodiments, any one of the transportation units are substituted for a bus unit (not shown) a space shuttle or any other mode of transportation. In another embodiment, there are additional transportation units. In another embodiment of the mix or match toy, the units have, instead of a transportation theme, a different theme. For example, the theme could be buildings, fashion, humans, fish, mammals or other animals (including insects, birds, etc), food, dinosaurs, botany, lab equipment, electronic devices, monsters, etc, and even combinations thereof.

Each unit is comprised of at least two sections. In one embodiment, each unit is comprised of at least three sections such that the automobile unit 2 comprises a front auto section 6, a second or middle auto section 7, and a rear auto section 8. Continuing the scenario, the airplane unit 3 comprises a front airplane section 9, a second or middle airplane section 10, and a rear airplane section 11. The locomotive unit 4 comprises a front locomotive section 12, a second or middle locomotive section 13, and a rear locomotive section 14. The boat unit 5 comprises a boat front section 15, a second or middle boat section 16, and a rear boat section 17.

The distal walls 18, 19, 20, 21 of front sections 6, 9, 12, 15, have female receptors 22, 23, 24, 25. The female receptors are shown as rectangular; however, in other embodiments, the female receptors are rectangular, oval, circular, triangular, pentagonal, or any other shape. Representative of all of the square female receptors, the automobile receptor has receptor side walls 200, 201, 202, 203 Within each of the female receptors 22, 23, 24, 25 there is at least one magnet which is either glued to the receptor rear wall 26, 27, 28, 29 of the female receptor 22, 23, 24, 25, or embedded into or within the plastic of the receptor rear wall 26, 27, 28, 29. In one embodiment, part of the magnet projects from the receptor rear wall 26, 27, 28, 29, magnet inserted through the front wall 26 from behind the front the wall 26. In one embodiment, two magnets either parallel, next to each other, or one on top of another, project from the front wall. In one embodiment, two magnets are positioned parallel and perpendicular to the length of the body of the structure, each of said magnets partially extending out from said receptor rear wall 26, 27, 28, 29.

In another embodiment, North and South poles 30 & 31; 32 & 33; 34 & 35; 36 & 37 comprising the two ends of the same magnet are projecting through the receptor end wall 26, 27, 28, 29, with the body of the magnet integral with the two poles positioned behind the front wall (not shown). The magnet is held in place by any method known in the art.

The rear ends or sections 8, 11, 14, 17 of each of the units have, at their proximal walls 38, 39, 40, 41, male projections 42, 43, 44, 45, containing or a material 46, 47, 48, 49, with sides 1000, 1001, 1002, and 1003 forming the male projection, which is attracted to a magnet. This material includes iron, nickel, cobalt, some alloys of rare earth metals, and some naturally occurring minerals such as lodestone. These materials while not magnets themselves, are ferromagnetic materials.

In one embodiment, the material is attached to the male projection by an adhesive (not shown). In another embodiment, the material is in the form of a plate 300, enveloped by the male projection 42, 43, 44, 45. The plate (herein labeled as the material 46, 47, 48, 49, positioned near the proximal walls 50, 51, 52, 53 of the male projection) of the male projection, is held in place by a cage 54,55,56,57, Again, using the automobile unit 2 as representative of the other units, within opposing indentations 400, 401 of the cage, and positioned at the top section 410 and bottom section 411 of cage 54 is clip 58 positioned in the same plane and opposite from clip 59. Clips 58, 59 are positioned on a base 60, and are positioned to push the ferromagnetic plate against proximal wall 50 having two parallel linear openings 62, 63 corresponding to the magnets of the female connector. The proximal wall 50 is integral with support columns 64, 65 for supporting the projection plate which has part of indentations 400, 401 for the clips.

Middle sections 7, 10, 13, 16 have a proximal end 66, 67, 68, 69, and a distal end 70, 71, 72, 73. As shown, the proximal ends have male projections 74, 75, 76, 77, and distal ends have female receptors 78, 79, 80, 81.

In another embodiment, the front sections 6, 9, 12, 15 comprise the male projection and the rear sections have the female receptors. Similarly, the position of the male projections and female receptors on the middle section can be reversed. In all cases, the shape of the female receptor corresponds to the shape of the male projection, and vice versa. The male or female receptors can be positioned through the walls prior to the walls being inserted into the various sections. These receptors can be snapped in, held in place by glue, or by any other means known in the art.

Each section of the individual units 2,3,4,5, have a top section 82, 83, 84, 85 and a bottom section 86, 87, 88, 89. The contour of the top sections 82, 83, 84, 85 are virtually identical to/with each other, and the contours of the bottom sections 86, 87, 88, 89 are virtually identical to/with each other. Thus, the various front, mid and end sections of the various embodiments are interchangeable. At least one mid-section of one vehicle can be interchanged with or added to another vehicle. Alternatively, a rear section can be interchanged. There are countless possibilities. The top sections and the bottom sections can be secured by any means known in the art, including glue, snapping together of a pin and hole, screwing the two sections together, etc.

The distal and proximal walls containing the projection and receptor are either inserted after the top and bottom sections are secured together or before. These walls can be glued into position snapped into position by pins, or by any other means known in the art. The walls are fitted within or at the ends of the contour.

The differences among the sections lies in the extensions extending from the sections, the features painted on the various sections of the vehicles, and the set of wheels on the front sections and rear sections of the vehicles. Also, non-contoured features that extend from the contour of the unit differ.

The automobile unit 2 has a hood 100 as part of the front section, painted on headlights 101, 101*a* and a set of mag wheels 102 103 held in place by an axle 104 which in turn is held in place by a grab split 105 on the underside of the front section of the automobile unit 2. The front section also has two side view mirrors 106, 107. As in all of the units, the proximal and distal ends of the sections are glued in or secured in place by any known method. Prior to inserting the distal or proximate ends, the appropriate magnetic or metal inserts are positioned through the front wall of the female receptor or through an opening in the distal or positioned through proximal walls for the male receptor.

The front section also comprises two door handles 113, 114, as well as a painted on front windshield 115, and two side windows 116, 117.

The middle section of the automobile unit has painted on windows 118, 119, door handles 120, 121, and a moon roof 122. The rear section of the automobile unit has another set of wheels.

The end section of the automobile unit 2 comprises two side windows 128, 129, a rear window 130, and, besides some other accoutrements, a set of mag wheels 131, 132, held in place by an axle 133, along with the male projection discussed supra.

The locomotive unit which is the locomotive comprises a front section having a cow catcher 134, two sets of four wheels 135, 136, 137, 138 held by two axles (not shown). The front section has two horns 140, 141 above the control room 142.

The middle section of the locomotive unit comprises air intake vents 143, 144 as well as vent 145 and two exhaust pipes 146, 147, and the end section of the locomotive unit comprises two air intake vents 148, 149, a fan ensemble 150, and a rear door (not shown), as well as two sets of locomotive wheels 152, 153, 154, 155, held by two axles (not shown).

The plane unit comprises a front section having a nose 156, pilots' windows 157, 158, and a set of wheels 159, 160 secured by means known in the art. The middle section of the plane unit has wings 161, 162 and painted on windows 163, 164, 165, 166, 167, 168. The rear section has a set of wheels 169, 170, horizontal stabilizers 171, 172 and vertical stabilizers 173, 174.

The boat unit has a front section having a rounded bow 175, a life preserver 176, and a set of wheels 177, 178. The middle section of the boat comprises a cabin superstructure and the rear section of the boat comprises the stem 179, with an open area 180 for passengers or fishermen as well as a set of wheels. There are other accoutrements extending from the rear section.

The various sections of the various transportation units can be interchanged. For example, a middle section for an automobile can be inserted in place of or in addition to the middle section for the airplane. In another example, the front section of the locomotive locomotive can be attached to the middle section of the boat, and the end section can be the end section from the airplane. There are numerous possibilities.

It will be apparent to those skilled in the art that various modifications and variations can be made to the disclosure described above without departing from the spirit or scope of the disclosure. Thus, it is intended that the present disclosure cover modifications and variations that come within the scope of the appended claims and their equivalents.

What I claim is:

1. A mix or match toy, said toy comprising a plurality of units having a similar theme, each of said units comprising at least three body sections comprising:

a) a front section, said front section comprising:

i) a front section body;

ii) a distal end, said distal end comprising a distal end wall, said distal end wall comprising female receptor connector fitted within said distal end wall, said female receptor connector comprising:

1) a top female receptor connector wall;

1) a bottom female receptor connector wall;

2) a first side female receptor connector wall;

3) a second side female receptor connector wall; and 4) a rear female receptor connector wall;

said rear female receptor connector comprising a ferromagnetic structure;

a shape of said female receptor connector being complementary to a shape of a male connector such that said each said male connector extending proximally from two other said sections is capable of fitting within said female receptor connector, and a ferromagnetic structure of said male connector being attracted to said ferromagnetic structure of said female receptor connector, wherein said male connector comprises:

aa) a top male connector wall, a middle of said top male connector wall interrupted by a first clip extending from an end wall;

bb) a bottom male connector wall, a middle of said bottom male connector wall interrupted by a second clip extending from said end wall;

cc) a first side male connector wall;

dd) a second side male connector wall;

ee) a front male connector wall;

said ferromagnetic structure of said male connector being positioned behind and in contact with said front male connector wall, said ferromagnetic structure of said male connector held in place by said first clip and said second clip pushing said ferromagnetic structure of said male connector against a rear section of said front male connector wall;

iii) a front section top contour, wherein said front section top contour matches the top contour of any other section;

iv) a front section bottom contour wherein said front section bottom contour matches the bottom contour of any other section; and v) a front section side contour, wherein said front section side contour matches the side contour of any other section;

b) a rear section, comprising:

i) a rear section body at a distal end;

ii) a rear section proximal end comprising:

A) a rear section proximal end wall;

B) said male connector extending from said rear section proximal end wall;

i) a rear section top contour, wherein said rear section top contour matches the top contour of any other section;

ii) a rear section bottom contour wherein said rear section w contour matches the bottom contour of any other section; and iii) a rear section side contour, wherein said rear section side contour matches the side contour of any other said side contour of any other section;

c) at least one non-reversible middle section, said middle section comprising:

i) a middle section body;

ii) a middle section proximal end, said middle section proximal end comprising:

A) a middle section proximal end wall; and

B) a second said male connector, said second said male connector extending from said middle section proximal end wall;

iii) a middle section distal end, said middle section distal end comprising:

A) a middle section distal end wall; and

B) a second said female receptor of said mix or match toy, said second said female receptor connector positioned within said distal end wall of said middle section distal end wall:

iv) a middle section top contour wherein said middle section top contour matches the top contour of any other section;

v) a middle section bottom contour wherein said middle section bottom contour matches the bottom contour of any other section; and vi) a side contour, wherein said side contour of said middle section matches the side contour of any other said side contour of any other section.

2. The mix or match toy of claim 1, wherein said similar theme is transportation.

3. The mix or match toy of claim 1, wherein the units are selected from the group consisting of an automobile, a locomotive, a boat, an airplane, and combinations thereof.

4. The mix or match toy of claim 3, wherein:

a) said front section further comprises a set of two wheels separated by an axle attached to and positioned under the bottom of the bottom contour; and b) said rear section further comprises a second said set of two wheels separated by an axle attached to and positioned under the bottom of the bottom contour.

5. The mix or match toy of claim 1, wherein a) each of said ferromagnetic structure of each said male connectors of said body sections comprises a ferromagnetic plate; and b) each of said ferromagnetic structure of each said female receptor connectors of said body sections comprises a magnet.

6. The mix or match toy of claim 1, wherein each of said ferromagnetic structure of each said male connectors of said body sections comprises a magnet; and wherein each of said ferromagnetic structure of said female receptor connectors of said body sections comprises a ferromagnetic material.

7. A mix or match toy, said toy comprising a plurality of units having a similar theme, each of said units comprising at least three body sections comprising:

a) a front section, said front section comprising:

i) a front section body;

ii) a distal end, said distal end comprising a distal end wall, said distal end wall comprising a male connector extending from said distal end wall, said male connector comprising:

aa) a top male connector wall extending from said distal end wall, a middle of said top male connector wall interrupted by a first clip extending from said distal end wall;

bb) a bottom male connector wall, a middle of said bottom male connector wall interrupted by a second clip extending from said end wall;

cc) a first side male connector wall;

dd) a second side male connector wall;

ee) a front male connector wall;

ff) a ferromagnetic structure being positioned behind and in contact with said front male connector wall, said ferromagnetic plate structure held in place by said first clip and said second clip pushing said ferromagnetic structure against a rear section of said front male connector wall;

a shape of said male connector being complementary to a shape of a female receptor connector such that each said male connector fits within said female receptor connector positioned proximally in two other said sections, and the ferromagnetic structure of said male connector being attracted to a ferromagnetic structure of said female receptor connector, said female receptor connector comprising:

1) a top female receptor connector wall;

2) a bottom female receptor connector wall;

3) a first side female receptor connector wall;

4) a second side female receptor connector wall; and 5) a rear female receptor connector wall, said rear female receptor connector comprising a ferromagnetic structure;

iii) a front section top contour, wherein said front section top contour matches the top contour of any other section;

iv) a front section bottom contour wherein said bottom contour of said front section matches the bottom contour of any other section; and v) a front section side contour, wherein said front section side contour matches the front section first side contour of any other said side contour of any other section;

b) a rear section, comprising:

i) a rear section body at a distal end;

ii) a rear section proximal end comprising:

A) a rear section proximal end wall;

B) said female receptor connector positioned within said rear section proximal end wall;

iii) a rear section bottom contour wherein said rear section bottom contour matches the bottom contour of any other section; and iv) a rear section side contour wherein said rear section contour matches the side contour of any other said side contour of any other section;

c) at least one non-reversible middle section, said middle section comprising:

i) a middle section body;

ii) a middle section distal end, said middle section distal end comprising:

A) a middle section distal end wall; and

B) a second said male connector, said second male connector extending from said rear section distal end wall;

iii) a middle section proximal end, said middle section proximal end comprising:

A) a middle section proximal end wall; and

B) a second said female receptor, said second female receptor connector positioned within said proximal end wall of said middle section proximal end wall;

iv) a middle section top contour wherein said middle section top contour matches the top contour of any other section;

v) a middle section bottom contour wherein said middle section bottom contour of matches the bottom contour of any other section; and vi) a middle section side contour, wherein said middle section side contour matches the side contour of any other section.

8. The mix or match toy of claim 7, wherein said similar theme is transportation.

9. The mix or match toy of claim 7, wherein the units are selected from the group consisting of an automobile, a locomotive, a boat, an airplane, and combinations thereof.

10. The mix or match toy of claim 9, wherein a) said front section further comprises a set of two wheels separated by an axle attached to and positioned under the bottom of the bottom contour; and b) said rear section further comprises a second said set of two wheels separated by an axle attached to and positioned under the bottom of the bottom contour.

11. The mix or match toy of claim 7, wherein each of said ferromagnetic structure of each of said male connector of said body sections comprises a ferromagnetic plate; and wherein each of said ferromagnetic structure of each of said female receptor connector of said body sections comprises a magnet.

12. The mix or match toy of claim 7, wherein each of said ferromagnetic structure of each of said male connectors of said body sections comprises a magnet; and wherein each of said ferromagnetic structure of each of said female receptor connectors of said body sections comprises a ferromagnetic plate.

* * * * *